US009099063B2

(12) United States Patent
Blanco

(10) Patent No.: US 9,099,063 B2
(45) Date of Patent: Aug. 4, 2015

(54) WORK STATION AND HANGING SYSTEM FOR STRINGED INSTRUMENTS

(71) Applicant: Luis M. Blanco, Tacoma, WA (US)

(72) Inventor: Luis M. Blanco, Tacoma, WA (US)

( * ) Notice: Subject to any disclaimer, the term of this patent is extended or adjusted under 35 U.S.C. 154(b) by 0 days.

(21) Appl. No.: 14/170,343

(22) Filed: Jan. 31, 2014

(65) Prior Publication Data

US 2014/0217872 A1 Aug. 7, 2014

Related U.S. Application Data

(60) Provisional application No. 61/759,944, filed on Feb. 1, 2013.

(51) Int. Cl.

| | |
|---|---|
| ***G10G 5/00*** | (2006.01) |
| ***A47B 81/00*** | (2006.01) |
| ***G10D 3/00*** | (2006.01) |

(52) U.S. Cl.

CPC ..... *G10G 5/00* (2013.01); *A47B 81/005* (2013.01); *G10D 3/00* (2013.01)

(58) Field of Classification Search

CPC ..... A47B 81/005; G10G 5/00
USPC ..... 312/237, 286, 283, 330.1; 211/85.6, 211/60.1; 206/314
See application file for complete search history.

(56) References Cited

U.S. PATENT DOCUMENTS

| | | | | |
|---|---|---|---|---|
| 911,159 | A * | 2/1909 | Ridley | 312/228 |
| 2,058,184 | A * | 10/1936 | Sherrard | 211/85.6 |
| 3,860,755 | A * | 1/1975 | Kimbell et al. | 381/109 |
| 5,346,168 | A * | 9/1994 | Astrella | 248/278.1 |
| 6,296,213 | B1 * | 10/2001 | Law et al. | 248/166 |
| 6,959,810 | B2 * | 11/2005 | Neilson | 206/314 |
| 8,167,148 | B2 * | 5/2012 | Jacobson et al. | 211/85.6 |
| 8,430,461 | B1 * | 4/2013 | Cole | 312/204 |
| 8,727,172 | B2 * | 5/2014 | Burgess et al. | 220/533 |
| 2004/0154940 | A1 * | 8/2004 | Minakuchi | 206/314 |
| 2005/0230334 | A1 * | 10/2005 | MacDonald et al. | 211/64 |
| 2006/0131251 | A1 * | 6/2006 | Stadler | 211/85.6 |
| 2011/0037286 | A1 * | 2/2011 | Nebel | 296/37.6 |
| 2013/0277250 | A1 * | 10/2013 | Allen | 206/314 |
| 2013/0322673 | A1 * | 12/2013 | Yuhara | 381/334 |

* cited by examiner

*Primary Examiner* — Daniel Rohrhoff
(74) *Attorney, Agent, or Firm* — Christensen O'Connor Johnson Kindness PLLC

(57) ABSTRACT

A stringed instrument work station and hanging system 10 includes a low profile cabinet 12 configured with a slide-out drawer 14 that is shaped to support a guitar or other type of stringed instrument when repairing, adjusting, or otherwise working on the instrument. The drawer includes longitudinal walls or rails for spanning between the drawer end walls (46) for not only holding tools and spare parts for the stringed instruments, but also for supporting the body portion of the stringed instrument when the instrument is positioned on the opened drawer. Various neck supports (78) and (80) are utilized with the drawer (14) for supporting the neck of the stringed instrument when being serviced. The neck supports (78) and (80) can be positioned at various locations across the drawer (14).

19 Claims, 8 Drawing Sheets

WORK STATION AND HANGING SYSTEM FOR STRINGED INSTRUMENTS

CROSS-REFERENCE TO RELATED APPLICATION

This application claims the benefit of U.S. Provisional Application No. 61/759944, filed on Feb. 1, 2013, which is herein expressly incorporated by reference.

BACKGROUND

The present invention pertains to work stations and hanging systems for stringed instruments, and in particular, guitars and similar instruments.

Before a musical performance, it is often necessary to adjust musical instruments, including guitars and other stringed instruments. There is often no convenient surface or bench on which to make adjustments or repairs to stringed instruments, especially when at a performance venue. Also, at a performance venue, once the guitar or stringed instrument is removed from its case, there are few locations at which to safely place the instrument and avoid inadvertent damage to the guitar from being bumped or otherwise disturbed. The present disclosure seeks to address the foregoing matters by providing a work station and hanging system for stringed instruments.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

A combined work and hanging station for a stringed instrument having a body, neck, and a head, for example, a guitar, includes a low profile cabinet; a drawer slidably engageable with the cabinet; support rails extending along the drawer and configured to support the body portion of the stringed instrument when lying on the opened drawer; a neck support positionable in the drawer to extend above the drawer to support the neck of the stringed instrument; and a hanging system carried by the cabinet for hanging the stringed instrument by the neck of the stringed instrument.

In accordance with a further aspect of the present disclosure, a plurality of support rails extend across the drawer so that the support rails present a support structure for the body of the stringed instrument. More specifically, two spaced-apart support rails extend across the drawer, with the support rails dividing the drawer into compartments. In a further aspect of the present invention, the support rails extend above the remainder of the drawer so that the instrument is supported by the support rails and not the other components of the drawer.

In accordance with a further aspect of the present disclosure, neck supports are positionable at either end of the drawer or at both ends of the drawer. They both support the neck portion of the instrument and also to optionally provide an abutment for the distal end of the body of the stringed instrument.

In accordance with a further aspect of the present invention, a plurality of neck supports are positionable in different positions within the drawer to support the neck portions of the instrument at different heights above the drawer and also to accommodate stringed instruments of different lengths.

In accordance with a further aspect of the present disclosure, the neck supports have an upwardly open notch for closely receiving the neck portion of the stringed instrument therein.

In accordance with a further aspect of the present invention, abutments are positioned in the drawer to hold the neck support in the upright position. Alternatively, a hinge can be used to attach the neck support to the drawer thereby to enable the neck support to rotate between a retracted position within the envelope of the drawer and an in-use position to extend above the drawer.

In a further aspect of the present invention, the hanger system includes a pair of spaced-apart prongs for receiving the neck portion of the instrument therebetween and for bearing against the adjacent head portion of the stringed instrument.

In accordance with a further aspect of the present invention, the hanging system includes a pair of spaced-apart parallel bars extending from the cabinet to define a gap to receive the neck portion of the stringed instrument therebetween, and to bear against the adjacent portion of the head of the stringed instrument. The spaced-apart bars are extendable and retractable relative to the cabinet. Also, upwardly open notches are formed in the parallel bars for receiving portions of the head portion of the stringed instrument therein, thereby preventing the stringed instrument from twisting relative to the parallel bars.

In accordance with a further aspect, the present disclosure includes a combined speaker and work station for a stringed instrument, comprising a speaker having a cabinet for encasing a speaker; a drawer slidably engageable with the speaker cabinet, with the drawer configured to receive and support the body of the stringed instrument thereon. In addition, a neck support projects from the open drawer to support the neck portion of the stringed instrument when the stringed instrument is positioned on the cabinet drawer.

In accordance with a further aspect of the present invention, support rails extend along the drawer and are adapted to receive and support the body portion of the stringed instrument thereon.

In accordance with a further aspect of the present invention, a hanging system is provided to project from the cabinet for supporting stringed instruments. The hanging system includes spaced-apart prongs for receiving the neck portion of the stringed instrument therebetween and for bearing against the adjacent portion of the head of the stringed instrument.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

The detailed description set forth below in connection with the appended drawings, where like numerals reference like elements, is intended as a description of various embodiments of the disclosed subject matter and is not intended to represent the only embodiments. Each embodiment described in this disclosure is provided merely as an example or illustration and should not be construed as preferred or advantageous over other embodiments. The illustrative examples provided herein are not intended to be exhaustive or to limit the disclosure to the precise forms disclosed. Similarly, any steps described herein may be interchangeable with other steps, or combinations of steps, in order to achieve the same or substantially similar result.

In the following description, numerous specific details are set forth in order to provide a thorough understanding of exemplary embodiments of the present disclosure. It will be apparent to one skilled in the art, however, that many embodiments of the present disclosure may be practiced without some or all of the specific details. In some instances, well-known process steps have not been described in detail in order not to unnecessarily obscure various aspects of the present disclosure. Further, it will be appreciated that embodiments of the present disclosure may employ any combination of features described herein.

The present application includes references to "directions," such as "forward," "rearward," "front," "back," "upward," "downward," "right hand," left hand," "in," "out," "extended," "advanced," and "retracted." These references and other similar references in the present application are only to assist in helping describe and understand the present invention and are not intended to limit the present invention to these directions.

Also, although the present application references guitars as an example of a stringed instrument with which the work station of the present disclosure may be used with, it is to be understood that the present work station is not limited to guitars, but can be used with many other types of stringed instruments, including for example, banjos, ukuleles, mandolins, and violas.

In the following description, various embodiments of the present disclosure are described. In the following description and in the accompanying drawings, the corresponding systems assemblies, apparatus and units are identified by the same part number, but with an alpha suffix. The descriptions of the parts/components of such systems assemblies, apparatus and units that are the same or similar are not repeated so as to avoid redundancy in the present application.

Figure 1:
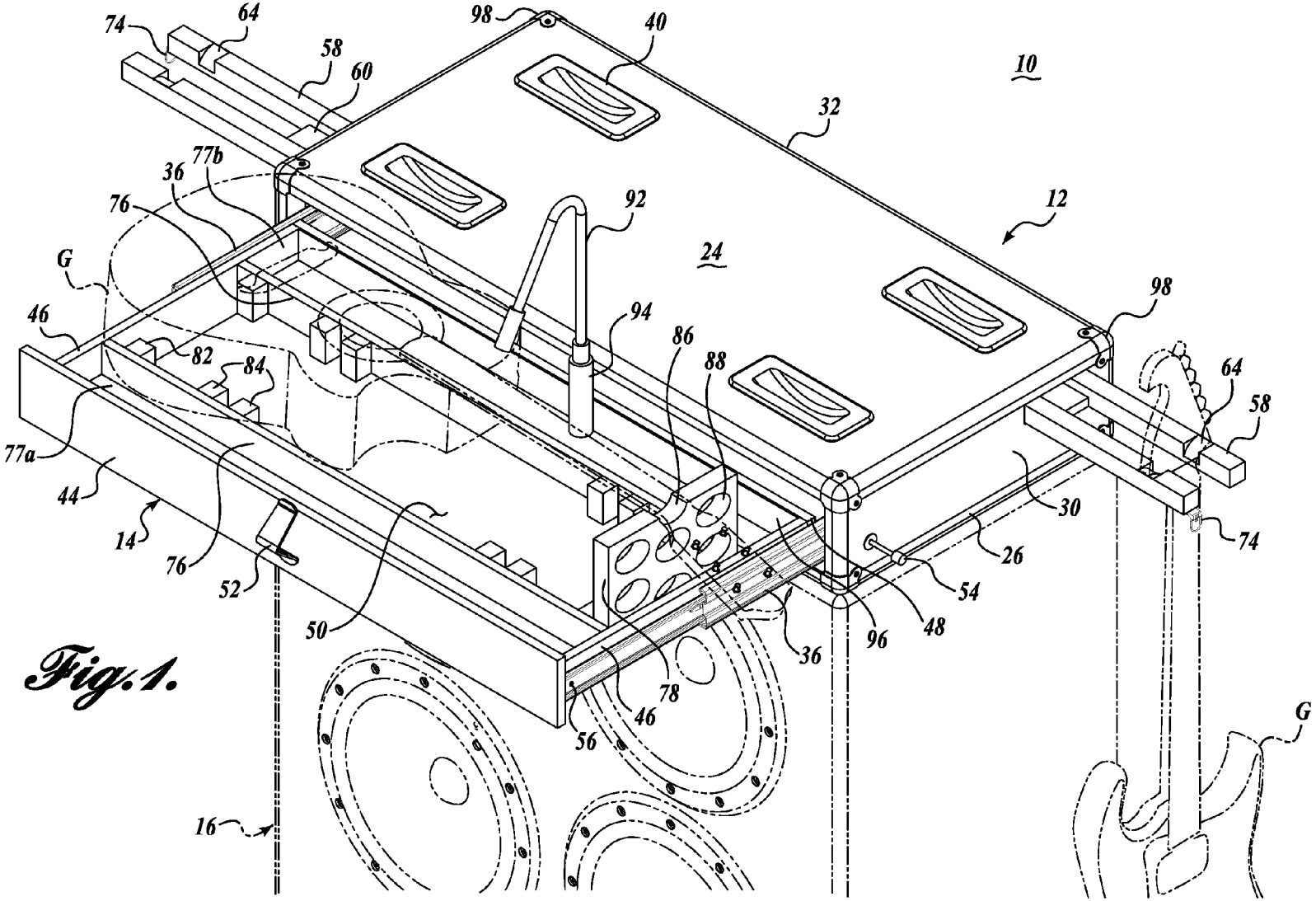
FIG. 1 is a front perspective view of a low profile guitar work station and hanging system of the present disclosure disposed on a speaker, and with the work station drawer shown in open position.

A stringed instrument work station and hanging system 10 is provided as consisting of a low profile cabinet 12 configured with a slide-out drawer 14 that is configured to support a guitar G or other type of stringed instrument when repairing, adjusting, or otherwise working on the instrument. The cabinet 12 is of low profile and designed to sit on an underlying speaker cabinet 16, as shown in FIG. 1, or other surface. The cabinet is sturdy enough to support upper speakers thereon, as well as a head (amplifier) and other equipment (not shown) on the upper speaker set. The height of the work station cabinet 12 is short enough to not appreciably increase the overall height of the stacked lower speaker cabinet 16, upper speaker cabinet, and head.

Describing the work station and hanging system 10 in more detail, the work station cabinet 12 is constructed in a rectilinear shape having a top panel 24 spaced from a bottom panel 26 by side walls 28 and 30 and a back wall 32. The cabinet 12 can be constructed from wood material, with high strength metallic telescoping slides 36 mounted to the exterior sides of drawer 14, and interior sides of walls 28 and 30. However, the speaker cabinet and drawer can be composed of other materials of suitable strength for the required function, including a variety of plastics and graphite/carton fiber reinforced materials, as well as metallic materials or a combination of these materials. The components of the cabinet 12 may be assembled using standard techniques, including adhesives and/or hardware fasteners to achieve high strength, unitary construction. It is to be understood that the top panel 24 can be attached to the remainder of the cabinet so as to be removable, for example, when desiring to prepare the hanging bars 56 described below.

As noted above, cabinet 12 is designed to support other equipment thereon, including an upper speaker set as well as an amplifier. To this end, four standard sockets 40 engage into openings formed in the cabinet top panel 24 to receive the wheels or cleats or other projections from either an overhead speaker or other equipment to be disposed on top of the cabinet 12. Other retention methods can be used in place of the sockets 40.

Figure 3:
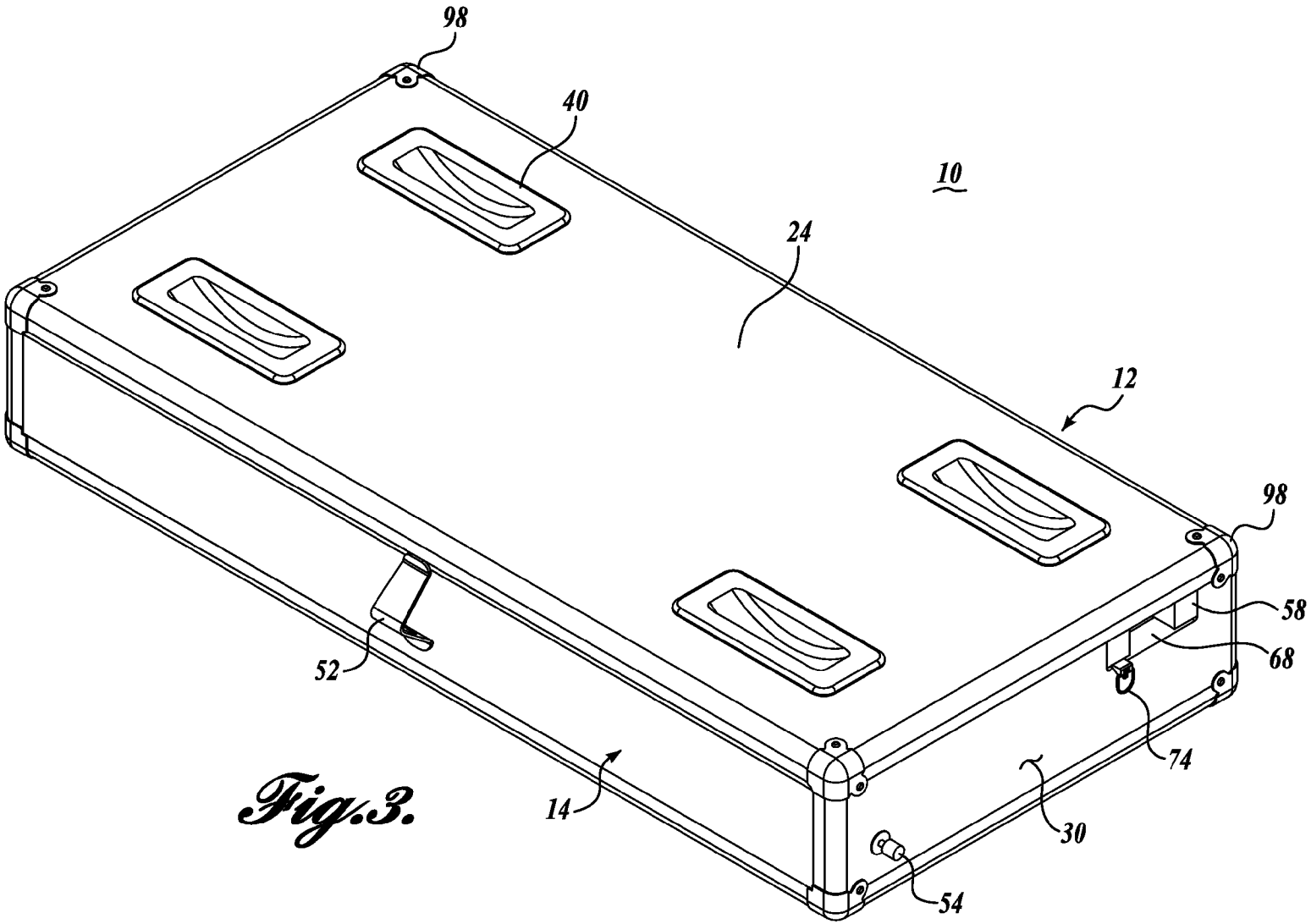
FIG. 3 is front corner perspective view of the guitar work station and hanging system of FIG. 1, shown with the work station drawer in closed position.
Figure 4:
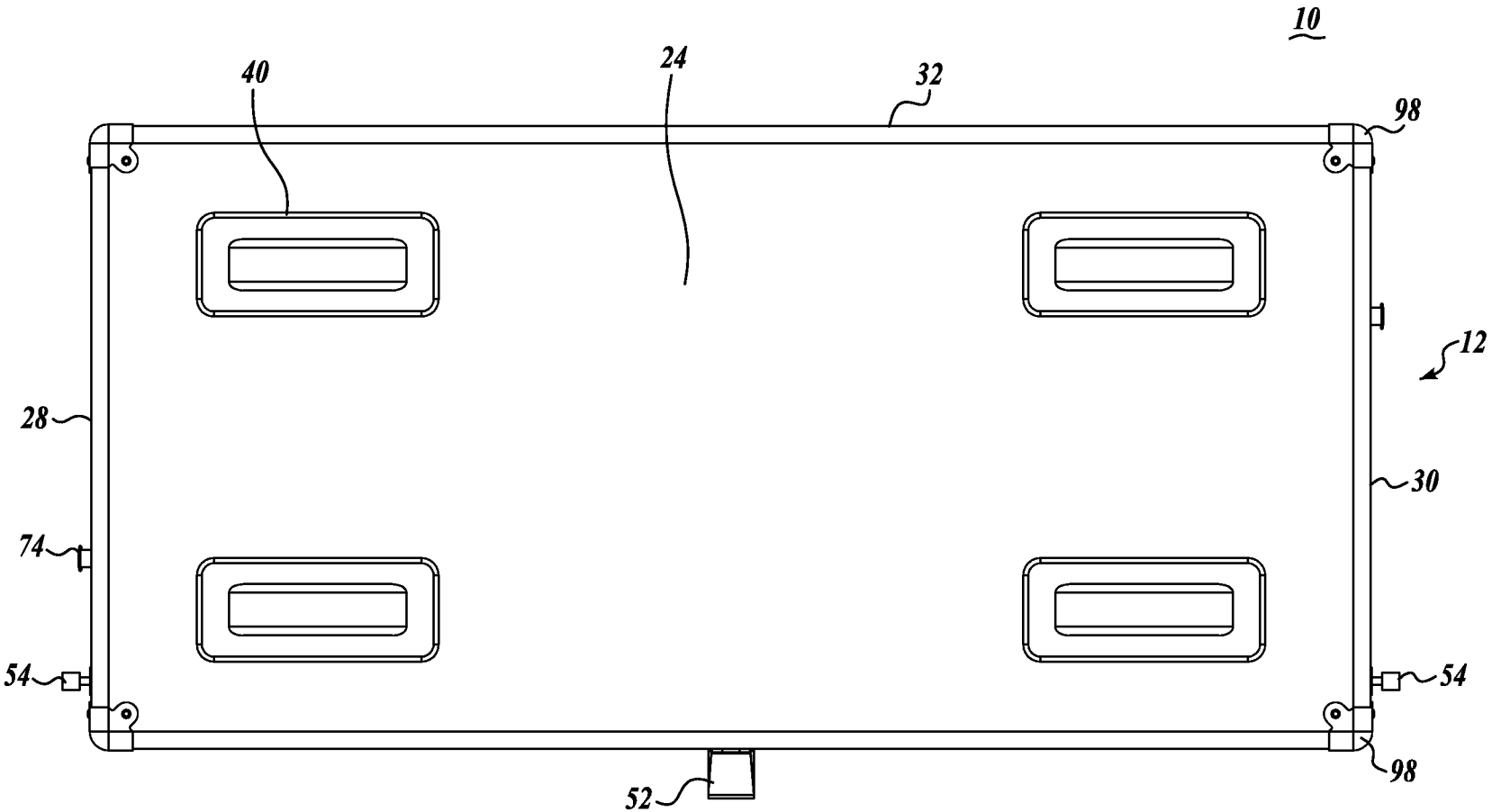
FIG. 4 is a plan view of FIG. 3 of the guitar work station and hanging system.
Figure 5:
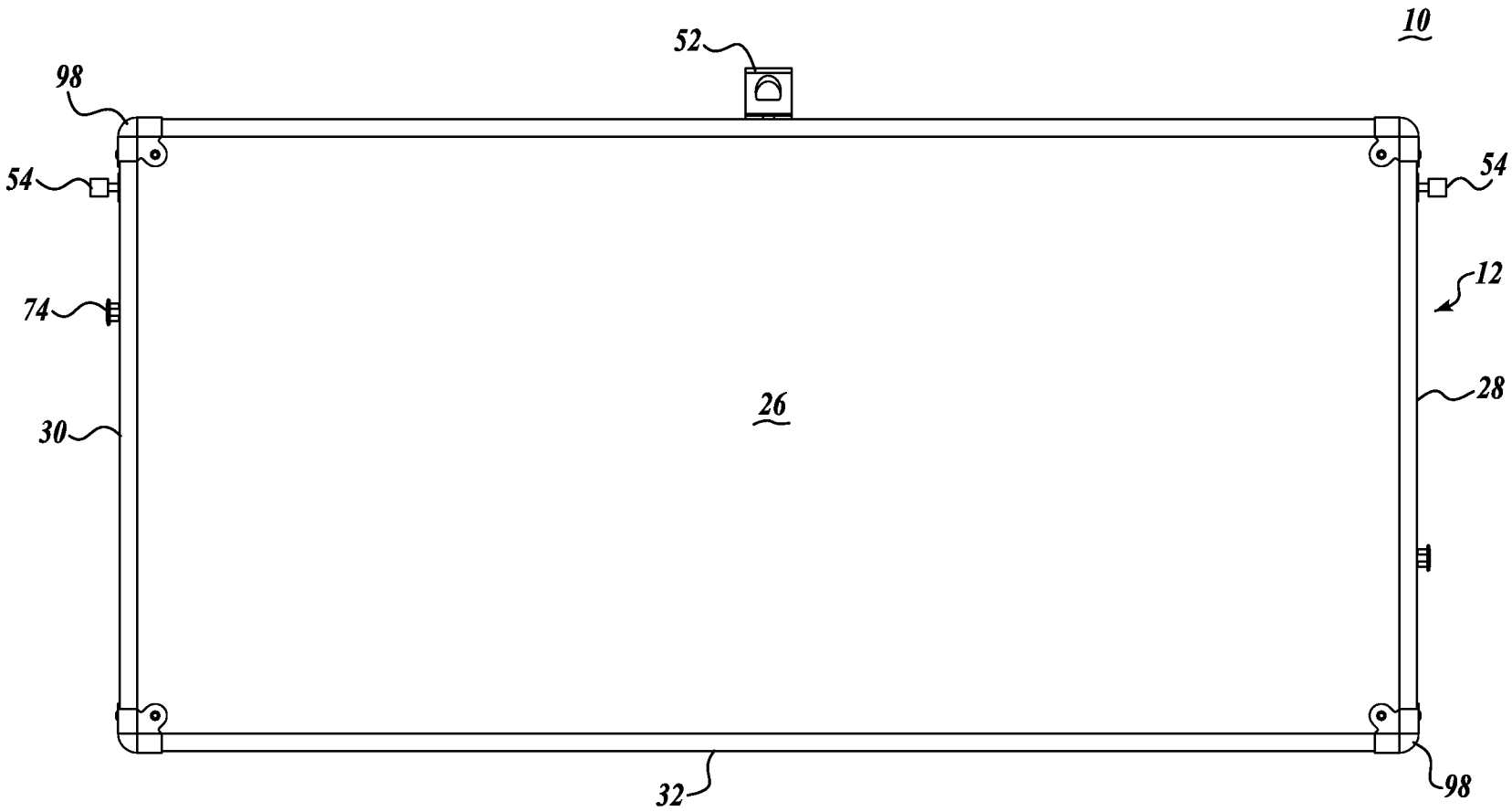
FIG. 5 is a bottom view of FIG. 3.
Figure 6:
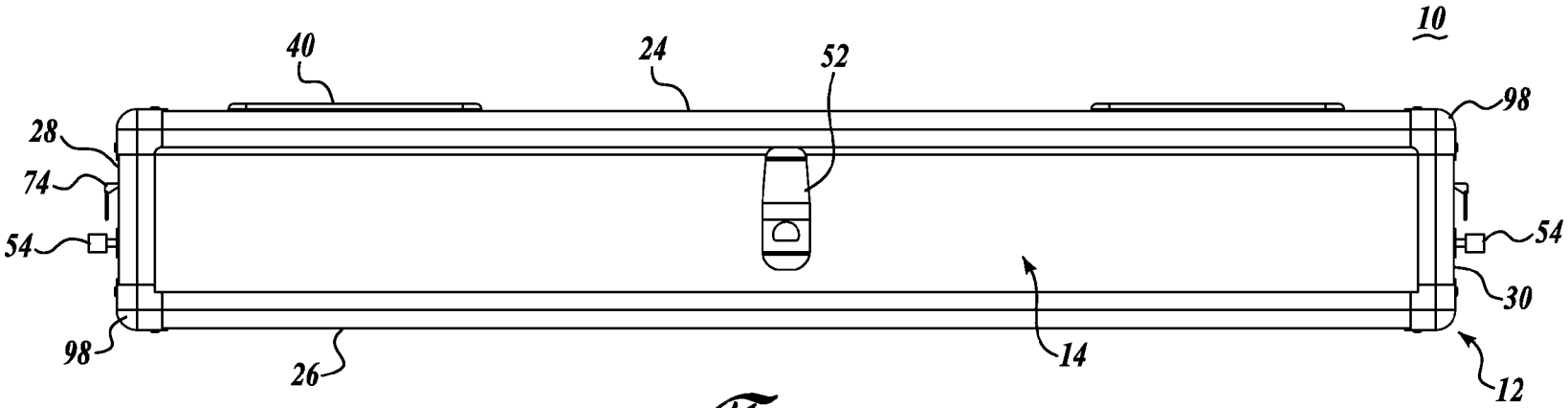
FIG. 6 is a front elevation view of FIG. 3.
Figure 7:
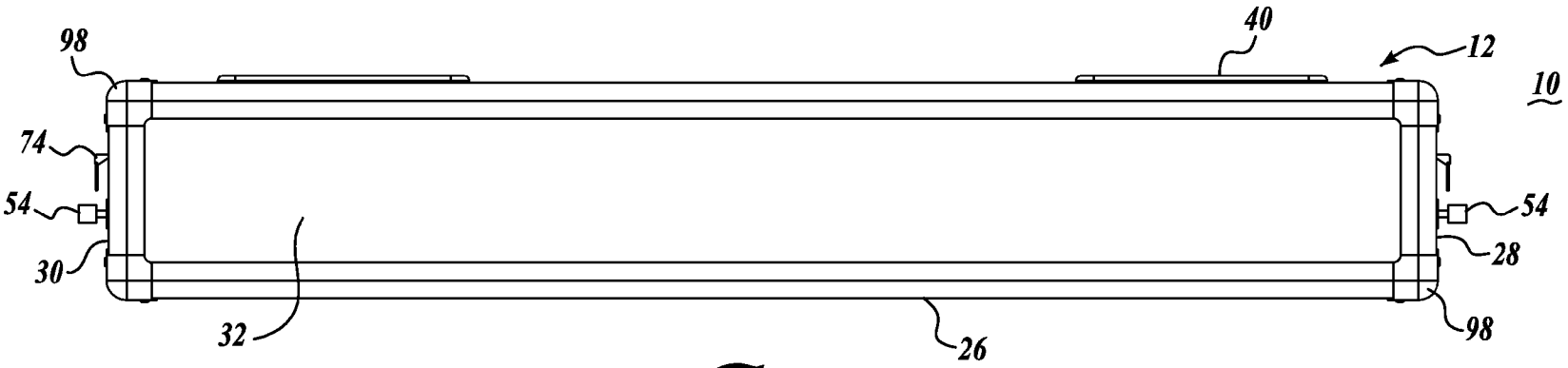
FIG. 7 is a rear elevation view of FIG. 3.
Figure 8:
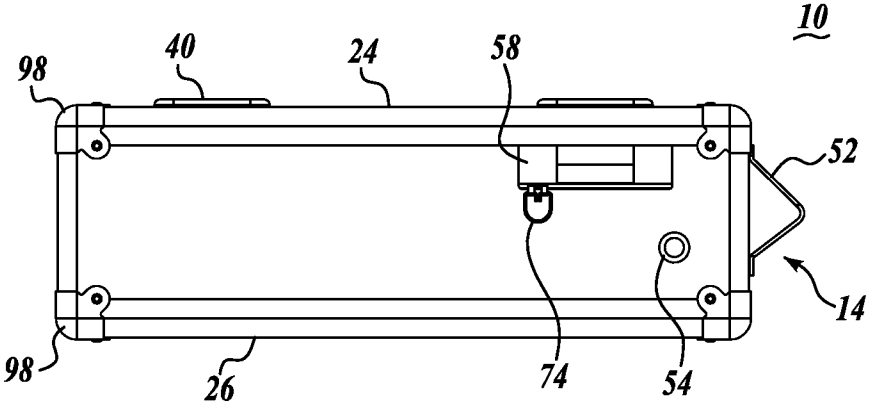
FIG. 8 is a left hand view of FIG. 3.
Figure 9:
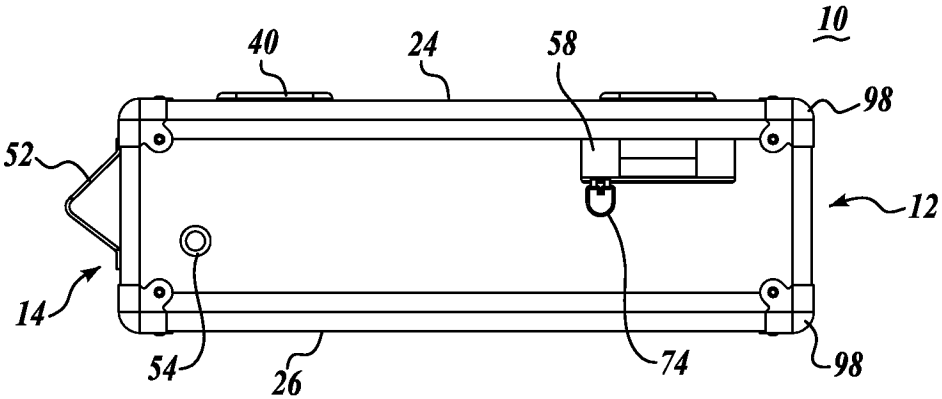
FIG. 9 is a right hand view of FIG. 3.

The drawer 14 in basic form includes a front panel 44 attached to the forward edge of side panels 46, with the rear ends of the side panels attached to the ends of a back panel 48. A bottom panel 50 is secured to the bottom edges of the side panels 46 and back panel 48 and to the front panel 44 above the lower edge of the front panel, so that when the drawer 14 is closed, the front panel 44 closes off the front opening of the cabinet 12 as shown in FIG. 3. A handle 52 is mounted to the drawer front panel 44 for convenient opening and closing of the drawer. Of course, other styles and types of handles can be used in place of the handle 52. Also, although the slides 36 are designed to retain the drawer 14 in closed position when the drawer is slid into the cabinet 12, a separate latch mechanism can also be utilized. For example, a slide pin 54 can be mounted to extend through cabinet side wall 30 to engage into a receiving hole 56 formed in the side panel 46 of the drawer 14. Further, a lock, separately or in conjunction with the latch, may be also installed on the work station 10.

As noted above, telescoping slides 36 are used to mount drawer 14 in cabinet 12. The telescoping slides 36 can be of "quick release" construction so that the drawer 14 can be conveniently removed from the cabinet 12 and placed on a table or other location when repairing or servicing the guitar, without having to move the cabinet 12, which would require removing the upper speaker and/or amplifier disposed on top of the cabinet 12.

Figure 2:
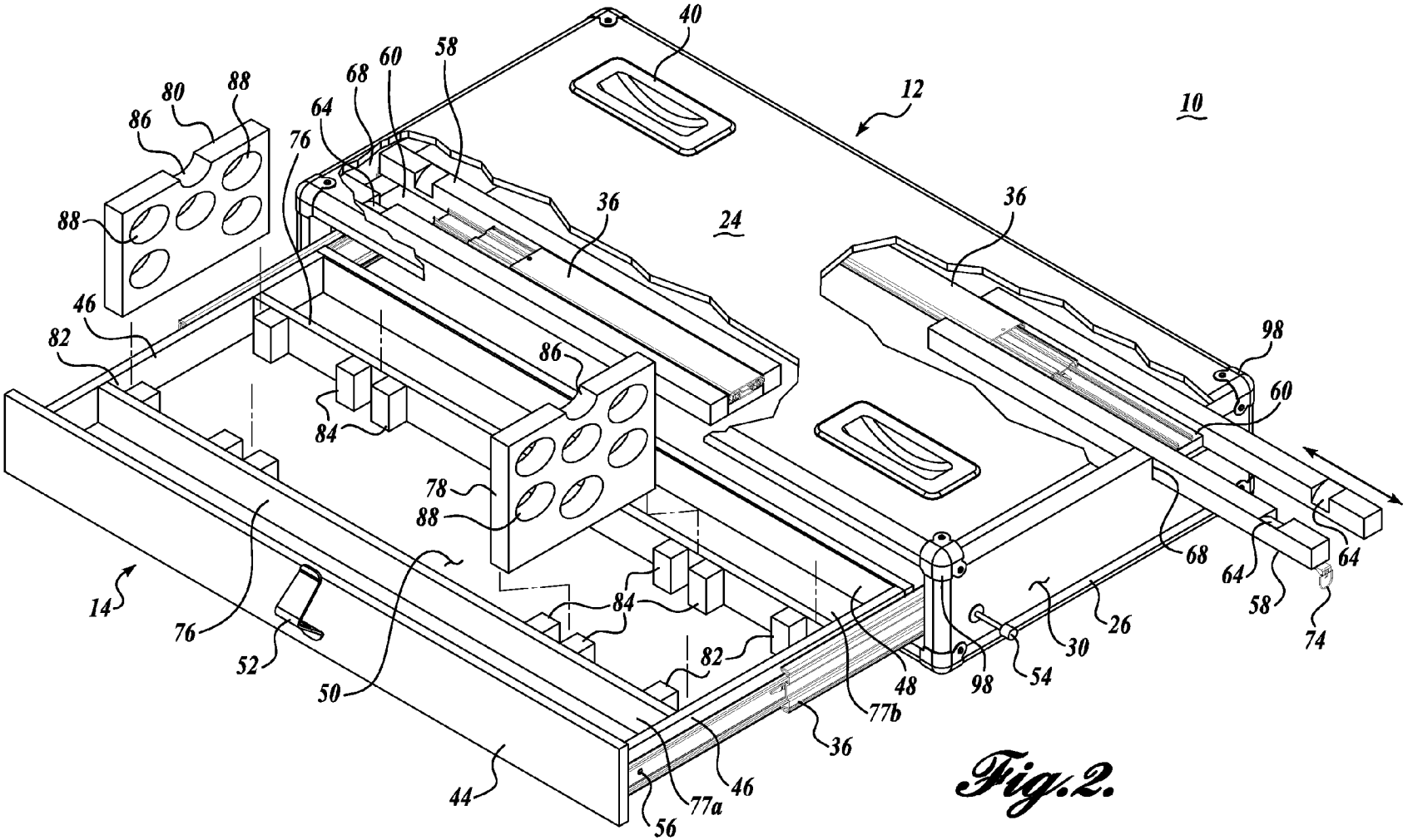
FIG. 2 is a front perspective view of the guitar work station and hanging system similar to FIG. 1, but with a portion broken away or removed to better show the construction of the interior of the work station.

Guitars can be supported from the work station 10 by pairs of hanging bars 58 that pull out in unison from each side of the work station 10, as shown in FIGS. 1 and 2. The bars 58 are located above the drawer 14. As shown in FIG. 2, the inward ends of the hanging bars 20 are connected together with a cross plate 60 that retains the inward ends of the bars together at a spaced parallel relationship to each other. In this manner, the bars 20 move together. The bars 20 attached to telescoping slides 62 that are attached to the under side of the cabinet top panel 24 by any convenient means and also attached to the cross plate 60. The bars 20 are extendable outwardly of the cabinet 12 into extended position and are retractable inwardly into the interior of the cabinet. As shown in FIGS. 1 and 2, notches 64 are formed in the bars 58 to position the neck of guitars along the bars 58 and prevent the guitars from twisting and thereby fall through the bars. The notches 64 can be spaced along the lengths of bars 58 such that a plurality of guitars can be spaced apart from each other and not bump against each other.

The bars 58 are illustrated as of square cross section. However, the bars 58 can be of other cross sectional shapes, for instance, rectangular, round, oval, etc. Also, in FIGS. 1 and 2, the bars 58 project out through the side walls 28 and 30 of the cabinet 12 through slots 68 formed in the side walls. Rather than being in the form of square bars 58, the bars could be in the form of prongs or tines, and as such perhaps smaller in cross-section than the bars 58 shown in FIGS. 1 and 2.

Cheek plates 70 can be attached to the exterior of the drawer side walls 28 and 30 and positioned so that the slots 72 of the cheek plates are in alignment with the slots 68 of the side walls. The cheek plates provide reinforcement for the portions of the cabinet side walls adjacent the slots 68, and assist in carrying the load imposed on the cabinet 12 by guitars or other instruments that may be suspended from the hanging bars 58. A manually graspable pull ring 74 or other means may be attached to the end of one of the hanging bars 58 to manually pull the hanging bars outward of the cabinet side walls 28 and 30 and also to retract the hanging bars 40 into the interior of the cabinet 12.

As an alternative construction, guitar hanging brackets (not shown) may be used in place of the bars 40. The hanging brackets can be spaced about the cabinet 12. Of course, other means can be used to hang or otherwise support guitars.

Construction of the interior of drawer 14 is illustrated in FIGS. 1 and 2. The drawer is sized and shaped for receiving and supporting the body of a guitar G or other stringed instrument.

The drawer 14 can be fitted with storage compartments 77*a* and 77*b* defined by longitudinal walls or dividers or rails 76 spanning between drawer end walls 46 for holding tools and spare parts for the guitar, including guitar strings. In addition, various neck supports 78 and 80 may be utilized with the drawer 14 for supporting the neck of the stringed instrument when the instrument is being serviced, for instance, as shown in FIG. 1. The neck supports 78 and 80 may be positioned in various locations across the drawer 14. Each neck support is in the form of a panel that may be disposed in upright orientation, as shown in FIGS. 1 and 2. To this end, pairs of support blocks 82 are spaced inwardly from the inside surfaces of drawer side walls 46 a distance to closely receive the neck supports 78 and 80 therebetween. As can be appreciated, the neck supports are held in place by the inside surface of the drawer walls 46 and the two support blocks 82. Such support blocks may be fixedly attached to both the drawer bottom panel 50 and the drawer divider wall 76. Additional sets of support blocks 84 may be positioned more centrally within the drawer 14 to receive the neck supports 78 and 80 between spaced-apart support block sets 84. These interior locations for the neck supports 78 and 80 may be used in conjunction with shorter instruments than the guitar G shown in FIG. 2.

Each of the neck supports 78 and 80 are configured with an upper cutout 86 to receive the instrument neck therein. The shape of the cutouts 86 can be customized to the guitars or other instruments of the user. A series of holes 88 extend through the neck supports 78 and 80 to facilitate manually grasping the neck supports when both inserting the neck supports between end wall 46 and support blocks 82 or removing the neck supports from such position. Of course, the same is true when installing the neck supports between support block pairs 84. Also, the holes help the user grasp the neck supports when the neck supports are in storage position, for example, when lying flat on the drawer bottom panel 50.

It will be appreciated that when a stringed instrument, such as a guitar, is being serviced, the instrument overlies the open drawer 14. To this end, portions of the drawer that make contact with the guitar or other instrument may be padded so as to protect the guitar or other instrument while being worked on. The padding can be located, for example, along the upper edges of the drawer end walls 46, back wall 48, and divider walls/rails 76. The padding can be composed of many suitable materials, such as felt, rubber, foam rubber, etc.

Various accessories can be utilized in conjunction with the instrument work station 10, including, as shown in FIG. 1, a work light 92 that helps illuminate the drawer when in open position. The work light 92 can have metallic handle portion 94 that may be placed against a metal strip 96 used to face the inside surface of the drawer back wall 48. In this manner, the work light 92 can be placed at any location along the width of the drawer and thereby direct the light at any desired location relative to the guitar G or other instrument being worked on while disposed on drawer 14. When not in use, the work light 92 can be stored in compartment 77*b*, whereat the base 94 of the light can attach to the metal strip 96, thereby to hold the light securely in place within the compartment 77*b*.

Rather than using a work light 92, instead, a light bar (not shown) may be built into the drawer 14 to illuminate the drawer when working on a guitar or other instrument. The light bar can be composed of an array of LED lights to provide a great deal of light with low energy expenditure. Also, the intensity of the lights can be varied to provide the desired level of working light.

Also, as shown in FIGS. 1-3, the handle 52 can be in the form of a bottle opener. Also, optionally, a beverage holder or well (not shown) can be built into the top panel 24 of the cabinet 12 so as not to protrude beyond the envelope of the cabinet, thereby not to catch or snag any objects, especially during moving or transport. In addition, protectors 98 can be utilized to overlie, and thus protect, the corners of the cabinet, as shown in the figures.

The exterior of the work station 10 can be covered with a flexible vinyl material of the same type commonly used to cover speakers and amplifiers. One such material is sold under the brand name Tolex®. In this manner, the work station will blend into the speakers, amplifier, or other audio equipment below or above the work station.

As an alternative, the exterior of the work station can be entirely or partially covered with speaker grill fabric rather than flexible vinyl material. In this manner, the work station will blend in with the grill portion(s) of the underlying or overhead speaker(s).

While the preferred embodiments of the work station and hanging system for stringed instruments has been illustrated and described, it will be appreciated that various changes can be made therein without departing from the spirit and scope of the invention.

For example, the work station 10 is described above as utilizing neck supports 78 and 80 that can be nominally stowed within the drawer 14 when not in use, and when in use, the neck supports can be positioned in upright orientation at either end of the drawer and supported thereat by support blocks 82 and the adjacent drawer side panels 46. Alternatively, the neck supports 78 and 80 may be positioned intermediate the ends of the drawer by pairs of support blocks 84. However, as an alternative construction, the neck supports 78 and 80 may be hinged to the drawer, for example, to the bottom panel 50 of the drawer. In this configuration, the neck supports 78 and 80 can be nominally rotated to lie against the bottom panel 50 for storage. For use, the neck supports 78/80 can be pivoted into upright orientation. Various types of hinges can be used to attach the neck supports 78 and 80 to the drawer, including piano hinges. It will be appreciated that the user's fingers can be placed within the holes 88 of the neck supports 78 and 80 to conveniently pivot the neck supports from retracted position to upright, in-use position.

Also, the divider walls or rails 76 that extend transversely along the front and rear of the drawer can be sized to extend somewhat above the height of the upper edges of the drawer side panels 46, so that the guitar can rest on the divider walls/rails when being serviced. As noted above, the divider walls can be padded so as to protect the underside of the guitar.

Alternatively, the divider walls 76 can be of a height that is the same as the side walls 46 of the drawer itself. The divider walls 76 cooperate with the front and rear panels of the drawer to define storage compartments 77*a* and 77*b*, as described above. Covers, not shown, can be hinged to the drawer or slidably engaged with the divider walls and front/rear walls of the drawer to close off the tops of the storage compartments 77*a* and 77*b*.

Also, as discussed above, neck supports 78 and 80 are locatable on each side of the drawer 14 so that the guitar or other stringed instrument can be positioned with the neck in the right hand direction or the left hand direction, as desired, when the guitar is being repaired, serviced, or otherwise worked on. The neck support 78 or 80 that is not being used to actually support the guitar neck can serve as a stop or abutment against the end of the guitar body to help restrain the guitar from moving when being repaired or serviced. Also when not in use, the neck supports can be removed and placed within the drawer 14 for storage.

Figure 10:
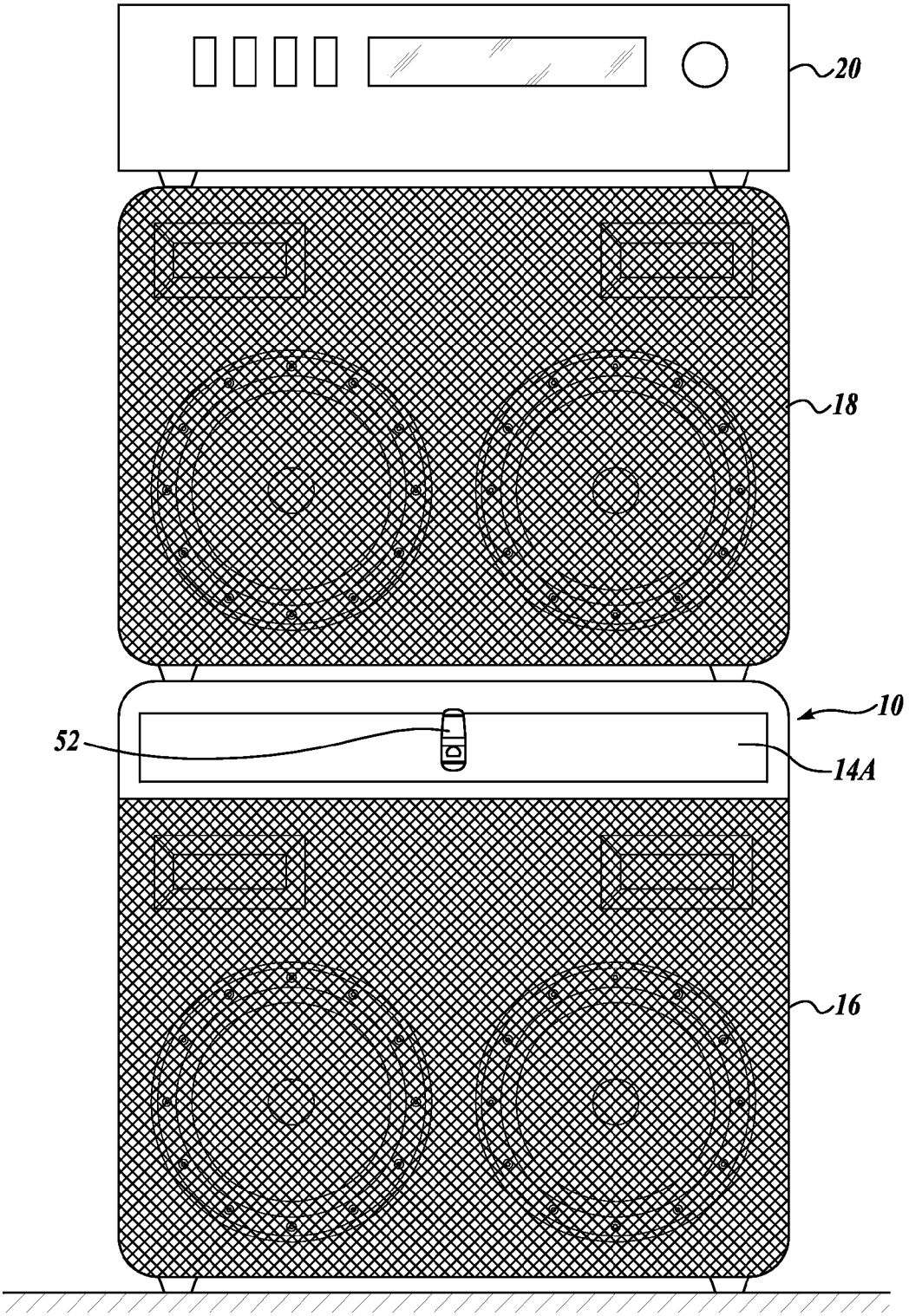
FIG. 10 is a perspective view of a further embodiment of the present disclosure.

The work station 10 can be incorporated into the cabinet of a loudspeaker similar to loudspeaker 16. In this regard, please see FIG. 10. As shown in FIG. 10, the top of the cabinet of the loudspeaker has an opening for receiving a drawer 14A therein. In FIG. 10, the components corresponding to work station 10 shown in FIGS. 1-9 are designated by either the same number or a corresponding number with an alpha suffix. Such components are constructed and operate the same or similarly to the corresponding components shown in FIGS. 1-9. Accordingly, such description will not be repeated here.

As shown in FIG. 10, a second speaker 18 is mounted on top of lower speaker 16. An amplifier 20 is located on top of the upper speaker 18. Of course, the amplifier could instead be positioned between the lower speaker 16 and the upper speaker 18.

The embodiments of the invention in which an exclusive property or privilege is claimed are defined as follows:

1. A combined work and hanging station for a stringed instrument having a body, a neck, and a head, comprising:

(a) a low profile cabinet;

(b) a drawer slidably engageable with the cabinet, the drawer having side portions defining a width and front and back portions defining a depth;

(c) a pair of support rails extending in spaced apart relationship along the width of the drawer, said support rails being separated by a distance to underlie and support the body portion of a stringed instrument when lying along the width of the opened drawer;

(d) a neck support positionable in the drawer adjacent a side portion of the drawer, said neck support aligned with the support rail and extending above the drawer to support the neck of the stringed instrument; and (e) a hanging system comprising at least one slidable member, the slidable member slidable outwardly from the interior to the exterior of the cabinet, the hanging system carried by the slidable member for hanging the stringed instrument by the neck of the stringed instrument.

2. The combined work and hanging station according to claim 1, comprises two spaced-apart support rails extending across the drawer, said two support rails dividing the drawer into compartments.

3. The combined work and hanging station according to claim 2, wherein said drawer side portions having end walls, and said support rails extending above the drawer end walls.

4. The combined work and hanging station according to claim 1, wherein the neck support is positionable at either end or at both ends of the drawer to support the neck portion of a stringed instrument and also optionally to provide an abutment for the distal end of the body of the stringed instrument.

5. The combined work and hanging station according to claim 1, wherein a plurality of neck supports are positionable in a supporting position within the drawer, said neck supports of differing heights above the drawer.

6. The combined work and hanging station according to claim 1, wherein the neck support comprises an upwardly open notch, said notch of a width and contour corresponding to the shape of the neck portion of a stringed instrument for receiving the neck portion of a stringed instrument into the notch.

7. The combined work and hanging station according to claim 1, further comprises abutments positioned in the drawer to hold the neck support in upright position.

8. The combined work and hanging station according to claim 1, further comprises a hinge to attach the neck support to the drawer and enable the neck support to rotate between a retracted position within the envelope of the drawer and an upright position to extend above the drawer.

9. The combined work and hanging station according to claim 8, wherein the neck support defining openings therein, said openings being manually graspable for rotation of the neck support relative to the drawer.

10. The combined work and hanging station according to claim 1, wherein the neck support having portions defining openings therethrough, said opening being manually graspable when placing the neck support into in-use position and when placing the neck support into storage position within the drawer.

11. The combined work and hanging station according to claim 1, wherein the hanging system comprising slidable member is a hanger extendable outwardly from and retractable into the cabinet.

12. The combined work and hanging station according to claim 11, wherein the hanger comprises a pair of spaced-apart prongs, for receiving the neck of the stringed instrument therebetween, and for bearing against the adjacent head portion of a stringed instrument.

13. The combined work and hanging station according to claim 12, wherein such spaced-apart prongs extending outwardly from the interior of the cabinet to define a gap therebetween to receive the stringed instrument neck, and for preventing the head of the stringed instrument to pass between the spaced-apart prongs.

14. The combined work and hanging station according to claim 13, wherein said prongs are configured to define notches formed therein to function as a seat for receiving the head portion of a stringed instrument.

15. The combined work and hanging station according to claim 1, wherein said hanging station comprises a pair of spaced parallel bars slidably extending outwardly from the cabinet to define a gap to receive the neck of the stringed instrument therebetween and to bear against the adjacent portion of the head of the stringed instrument, said spaced-apart bars extendable out from and retractable into to the cabinet.

16. The combined work and hanging station according to claim 15, wherein said bars have portions defining upwardly open notches, for receiving portions of the head portion of the stringed instrument.

17. A combined speaker and work station for a stringed instrument, comprising:

(a) a speaker having a cabinet for encasing the speaker;

(b) a drawer slidably engageable within the speaker cabinet, the drawer having side portions defining a width and front and back portions defining a depth, the drawer including divider walls separated by a distance to underlie and support a body of a stringed instrument thereon; and (c) a neck support positioned adjacent a side portion of the drawer, the neck support comprising an upwardly open notch, said notch of a width and contour corresponding to the shape of a neck portion of the stringed instrument, the neck support projecting from the drawer for receiving the neck portion of the stringed instrument into the notch when the stringed instrument is disposed on the cabinet drawer.

18. The combined speaker and work station according to claim 17, wherein said divider walls extend in spaced apart relationship along the width of the drawer to underlie and support the body portion of the stringed instrument when lying along the width of the opened drawer.

19. The combined speaker and work station according to claim 17, further comprising a hanging system projecting from the cabinet and comprising at least one slidable member slidably extendable from the speaker cabinet for receiving the neck of the stringed instrument therebetween and bearing against the adjacent portion of the head of the stringed instrument.

* * * * *